United States Patent [19]

Vianello et al.

[11] Patent Number: 4,644,872

[45] Date of Patent: Feb. 24, 1987

[54] DEPRESSED FLOOR TURNCAGE FOR ARTICULATED RAIL VEHICLES

[75] Inventors: Giorgio Vianello; Ugo Soloni, both of Padova, Italy

[73] Assignee: Officina Meccanica Della Stanga-O.M.S. S.p.A, Padova, Italy

[21] Appl. No.: 623,015

[22] Filed: Jun. 21, 1984

[30] Foreign Application Priority Data

Jun. 28, 1983 [IT] Italy ..... 61950/83[U]

[51] Int. Cl.[4] ..... B61D 17/20

[52] U.S. Cl. ..... 105/801; 105/4.1; 105/180

[58] Field of Search ..... 105/3, 8 R, 4 A, 180, 105/182 R, 4 R, 15, 165, 169, 180

[56] References Cited

U.S. PATENT DOCUMENTS 566,712 8/1896 Cooper ..... 105/8 R 2,216,547 10/1940 Christianson ..... 105/3

2,225,951 12/1940 Christianson ..... 105/15

2,650,547 9/1953 Anderson et al. ..... 105/8 R X 3,030,897 4/1962 Barry ..... 105/3 X 3,922,971 12/1975 Maroshick ..... 105/3 X 4,064,809 12/1977 Mulcahy ..... 105/180

*Primary Examiner*—Robert B. Reeves

*Assistant Examiner*—Scott H. Werny

*Attorney, Agent, or Firm*—Kimmel, Crowell & Weaver

[57] ABSTRACT

The articulated joint for urban and suburban transport vehicles running on rails, in particular for tramway and/or underground railway vehicles, comprises a turn cage (2) which has its platform (16) substantially coplanar with the depressed floor of the adjacent bodies (1) and possesses two lateral compartments (17) which extend upwards beyond the platform (16) and house the wheels (6) of the bogie (3), the suspensions (10,11), the shock absorbers (14,15) and the braking members (8,9).

3 Claims, 8 Drawing Figures

DEPRESSED FLOOR TURNCAGE FOR ARTICULATED RAIL VEHICLES

The invention relates to an articulated joint for urban and suburban transport vehicles running on rails, in particular for tramway and/or underground railway vehicles.

Known articulated vehicles used for urban and suburban transport on rails differ from railway carriages in terms of their use, by virtue of the short duration of halts, the short time for which passengers remain on board, and the fact that entry and exit generally take place through different doors. This obliges passengers to enter and exit rapidly, and requires them to transfer from the one to the other door inside the vehicle while it is running. These particular requirements, which are satisfied more comfortably and effectively the closer the vehicle floor is to the rail level, especially in facilitating the use of the public vehicle by elderly and/or handicapped persons, are in contrast with the constraints imposed by the bogies. In this respect, these are of substantial height because of the presence of the axle, the brakes, the motor, the suspensions and the shock absorbers, and this generally means that the coach floor, at least in positions corresponding with the bogies, cannot be lower than a certain minimum height (about 800 mm).

For this reason, a known solution to the aforesaid problem is to dispose the coach floor at a level which gives comfortable access to passengers (for example 400–450 mm) and to raise it at the bogies. The two different levels are connected together by steps, which obviously constitute a negative aspect of this solution in that they hinder and sometimes prevent free transfer of passengers through the coach.

It has also been proposed to construct bogies with very small wheels (about 300 mm diameter against the 600–680 mm of normal wheels), but this solution has also proved unsatisfactory both because it can obviously only be applied to the supporting bogies (pivoted bogies) and not to the motorised bogies due to the overall size of the motor itself, and because of the need to remove the braking system from such bogies, and finally because of the substantial wear which results from the reduced wheel diameter.

The object of the invention is to obviate the drawbacks of known articulated vehicles for urban and suburban transport by means of an articulated joint which enables the vehicle floor to occupy a single plane which extends continuously from one end of the other.

This object is attained according to the invention by an articulated joint for urban and suburban transport vehicles running on rails, particularly for tramway and/or underground railway vehicles, characterised by comprising a turn cage which has its platform substantially coplanar with the depressed floor of the adjacent bodies and possesses two lateral compartments which extend upwards beyond the platform and house the bogie wheels, the suspensions, the shock absorbers and the braking members.

Essentially, the invention is based on the fact that as the turn cage is rotatably rigid with the bogie, even when traversing bends there is no change in the overall space taken up by the wheels and the suspension and braking members. These can therefore be housed in the two side zones of the turn cage, and although these can be of greater height than the turn cage platform, they are sufficiently narrow to provide a continuous passage between the two adjacent bodies, which are constructed with a depressed floor.

In order to make the turn cage platform and thus the continuous floor of the vehicle even lower, the bogie wheels can be of independent type, i.e. without an axle.

Again according to the invention, the articulated joint can have the turn cage of a greater longitudinal size than the diameter of conventional cylindrical turn cages, and with transversal size not greater than the transversal encumbrance of the bodies, the distance between wheel centres of the bogie being consequently greater.

The present invention is described in detail hereinafter with reference to the accompanying drawings, in which.

Figure 1:
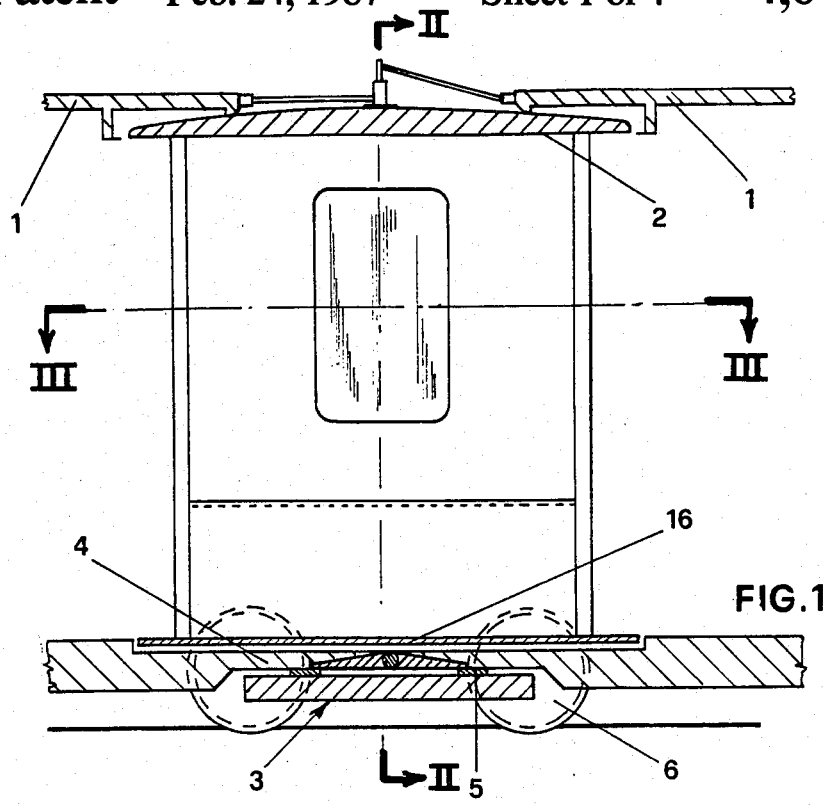
FIG. 1 is a partial vertical longitudinal section through a portion of an urban or suburban rail-running vehicle provided with a depressed floor and an articulated joint according to the invention.
Figure 2:
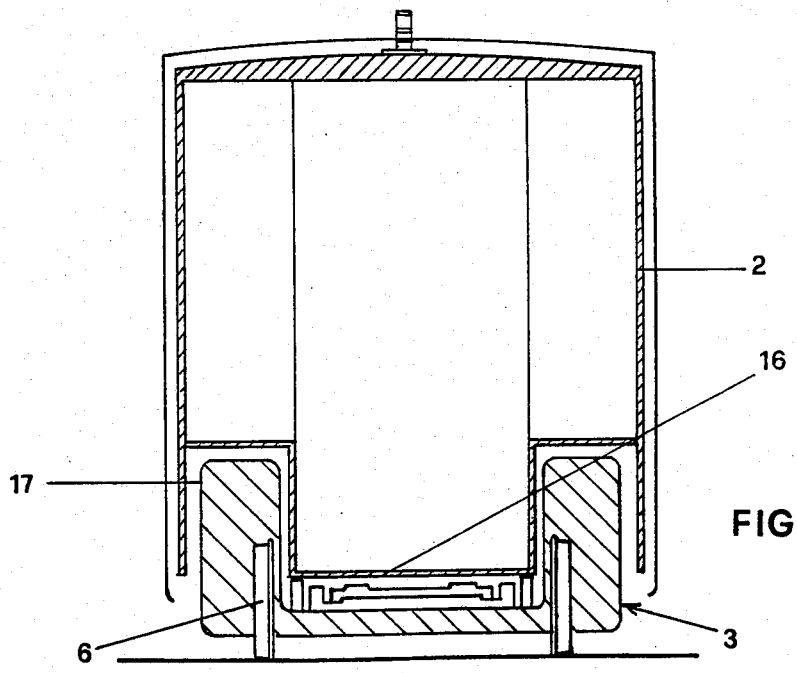
FIG. 2 is a vertical section on the line II—II of FIG. 1.
Figure 3:
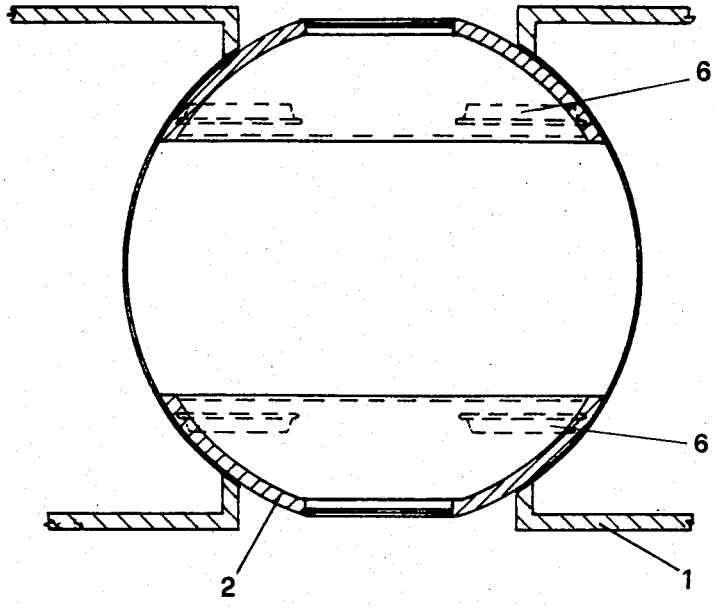
FIG. 3 is a horizontal section on the line III—III of FIG. 1.
Figure 5:
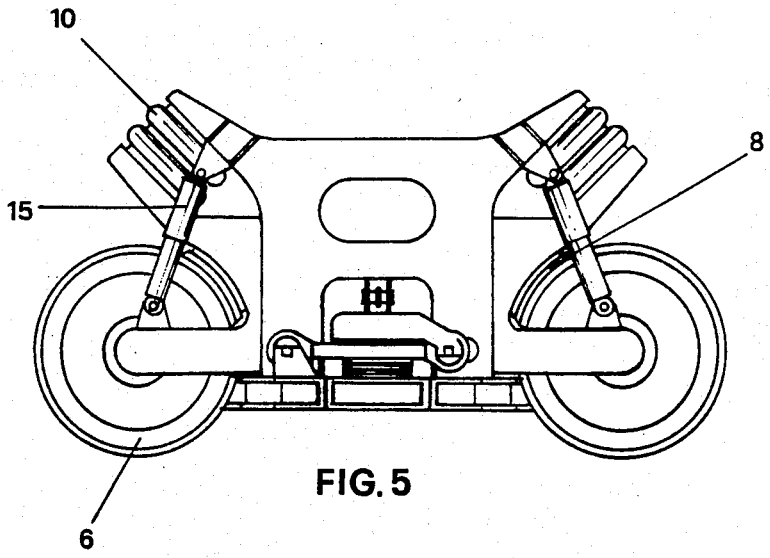
FIG. 5 is a side view on the line V—V FIG. 4.
Figure 4:
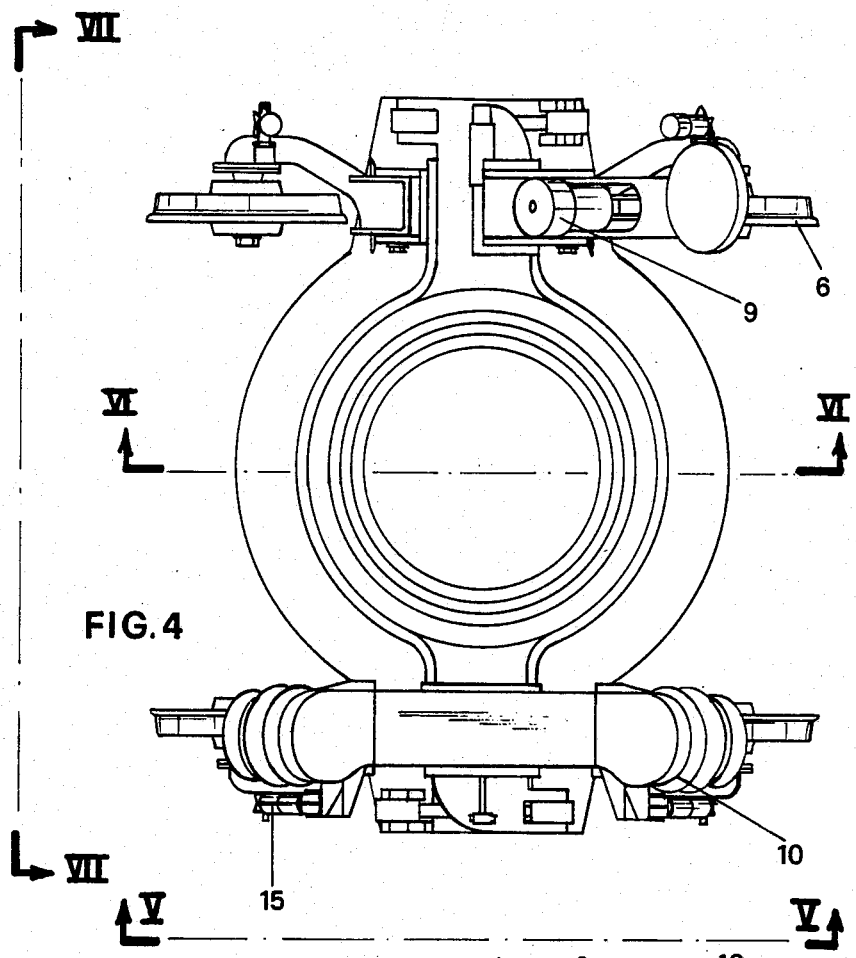
FIG. 4 is an enlarged detailed plan view of the bogie carrying the articulate joint.
Figure 6:
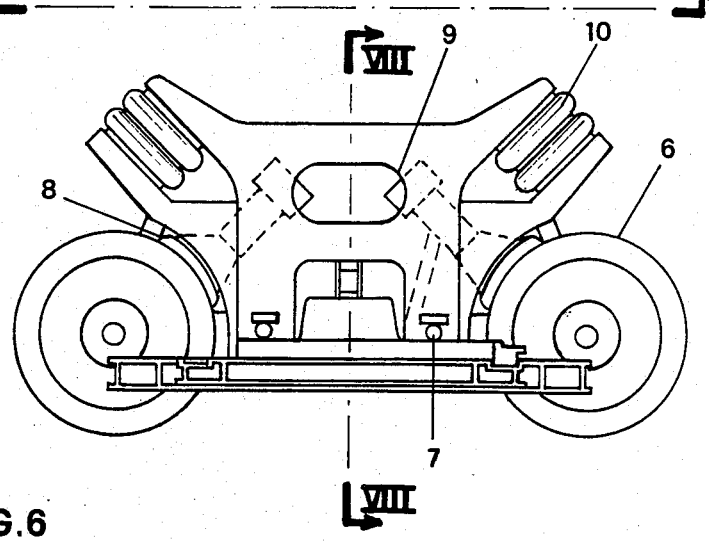
FIG. 6 is a vertical section on the line VI—VI of FIG. 4.
Figure 7:
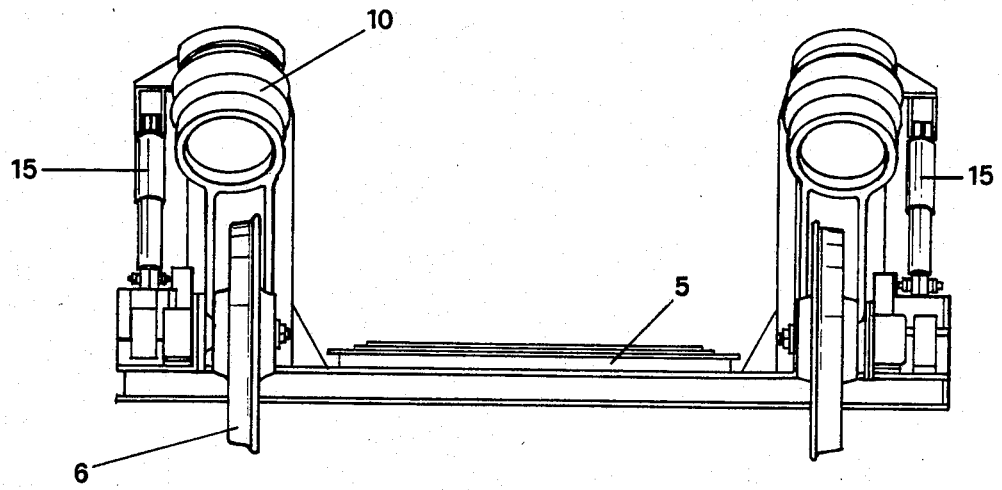
FIG. 7 is a front view on the line VII—VII of FIG. 4.
Figure 8:
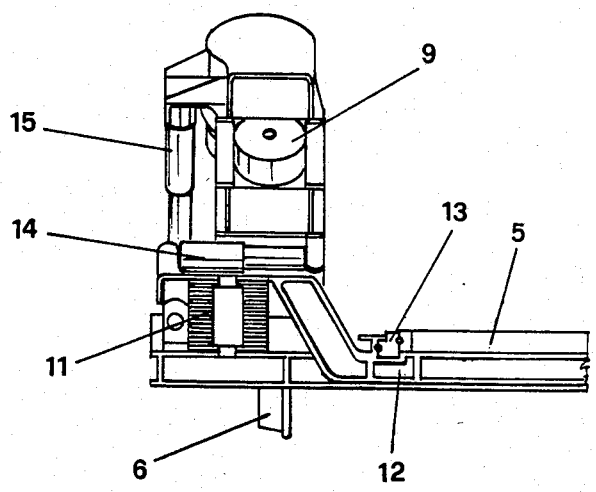
FIG. 8 is a section on the line VIII—VIII of FIG. 6.

As can be seen from the figures, the articulated joint according to the invention which connects together two bodies 1 of an urban or suburban transport vehicle, for example a tramway vehicle, comprises a turn cage 2 mounted on a bogie indicated overall by 3.

The bodies 1 are constructed with a depressed floor, i.e. an inner floor which is about 400 mm above the rail level. They are provided at their ends with an appendix 4 pivoted to a thrust block 5 provided in the bogie 3.

The turn cage 2 is of substantially cylindrical configuration and has diameter slightly greater than the diameter of conventional turn cages although having an overall transverse dimension less than that of the bodies 1.

As stated, the turn cage 2 is mounted on a bogie 3 comprising four independent wheels 6 fitted to a structure 7 which also supports the brake shoes 8 operated by conventional pneumatic cylinders 9. A swing beam 12, on which the thrust block 5 is mounted by means of bearings 13, is also fitted to the structure 7 by means of primary suspensions 10 and secondary suspensions 11.

Four horizontal shock absorbers 14 and vertical shock absorbers 15 of known type are also disposed between the structure 7 of the bogie 3 and the swing beam 12.

The horizontal shock absorbers 14, the vertical shock absorbers 15, the primary suspensions 10, the secondary suspensions 11 and the operating cylinders 9 for the braking system occupy an overall space which extends upperly beyond the platform 16 of the turn cage 2, this platform covering the thrust block 5 and the appendices 4 of the bodies 1. These members are housed in two lateral compartments 17 of the turn cage 2, which practically cause no obstruction to the free transfer of passengers from one body 1 to the adjacent body, and in fact being limited upperly to a height comparable to that of the vehicle seats they form two benches which can be used as seats themselves.

In order to enable the platform of the turn cage 2 to be situated in the lowest possible position relative to the rail level, the platform being coplanar with the floor of the bodies 1, the wheels 6 as stated are of independent type, i.e. without an axle.

Furthermore, the diameter of the turn cage 2, which as stated exceeds the diameter of conventional turn cages, enables the distance between the wheel centres of the bogie 3 to be sufficient to prevent bogie hunting, which is inevitably present if the distance between wheel centers is small.

We claim:

1. An articulated joint for urban and suburban transport vehicles running on rails, in particular for tramway and/or underground railway vehicles having at least two adjacent bodies with depressed floors and comprising a turn cage (2), which:

is interposed between the adjacent bodies, has a platform (16) substantially coplanar with the depressed floors of the adjacent bodies (1), is provided with a bogie (3) rotationally bound to it, having wheels (6) of independent type and having a horizontal dimension not greater than that of said turn cage (2), possesses two lateral compartments (17) which extend upwards beyond the platform (16) and house the wheels (6) of said bogie (3), suspensions (10, 11) shock absorbers (14, 15) and braking members (8, 9), and said bogie (3) being provided with a thrust block (5), to which there are pivoted two appendices (4) provided with the bodies (1), this assembly being covered by said platform (16) disposed substantially at the same level as the floor of the adjacent bodies.

2. An articulated joint as claimed in claim 1, characterised by having the turn cage of a transversal size not greater than the tansversal encumbrance of the bodies (1) and a longitudinal size greater than said transversal size.

3. An articulated joint as claimed in claim 1 characterised in that the maximum height of the two lateral compartments (17) is substantially equal to that of the vehicle seats.

* * * * *